United States Patent [19]

Bisping et al.

[11] Patent Number: 4,524,695

[45] Date of Patent: Jun. 25, 1985

[54] FINNED SUBCALIBER PROJECTILE

[75] Inventors: Bernhard Bisping, Ratingen-Hösel; Klaus Gersbach, Willich; Hans Luther, Kaarst; Walter Simon, Aachen; Peter Wallow, Dusseldorf, all of Fed. Rep. of Germany; Patrick Montier; Pierre A. Moreau, both of Bourges, France; Jean C. Sauvestre, Saint-Doulchard, France

[73] Assignee: Etat Francais, Paris Armees, France

[21] Appl. No.: 654,528

[22] Filed: Sep. 25, 1984

Related U.S. Application Data

[63] Continuation of Ser. No. 300,107, Sep. 8, 1981, abandoned.

[30] Foreign Application Priority Data

Sep. 23, 1980 [FR] France ..... 80 20381

[51] Int. Cl.[3] ..... F42B 5/02

[52] U.S. Cl. ..... 102/430; 102/520; 102/703; 102/431

[58] Field of Search ..... 102/430–434, 102/520–523, 436, 439, 443, 464, 517, 703; 89/1.806

[56] References Cited

U.S. PATENT DOCUMENTS

| | | | |
|---|---|---|---|
| 2,798,433 | 7/1957 | Allan | 102/522 |
| 3,038,382 | 6/1962 | Noyes et al. | 102/521 X |
| 3,262,391 | 7/1976 | Shober | 102/521 |
| 3,602,091 | 8/1971 | Fryklund et al. | 89/1.806 |
| 3,797,396 | 3/1974 | Reed | 102/464 X |
| 3,893,366 | 7/1975 | Murray | 89/1.806 X |
| 3,978,792 | 9/1976 | Campoli et al. | 102/703 X |
| 3,981,246 | 9/1976 | Luther et al. | 102/521 |
| 4,444,114 | 4/1984 | Bisping et al. | 102/523 |

FOREIGN PATENT DOCUMENTS

| | | | |
|---|---|---|---|
| 4926 | of 1890 | United Kingdom | 102/520 |
| 765169 | 1/1957 | United Kingdom | 102/521 |

*Primary Examiner*—Harold J. Tudor
*Attorney, Agent, or Firm*—Parkhurst & Oliff

[57] ABSTRACT

The technical area of the present invention relates to an anti-tank weapon comprising a finned projectile of the arrow type and a launching shoe.

The projectile of the invention comprises a shoe 2 the rear portion of which has fins 10 provided with pins 11 which rest against the compression cone 7 of the tube of the weapon. These fins make it possible to obtain practically constant compressive pressure and assure a proper guidance of the projectile during the barrel phase.

Application to the field of armaments.

18 Claims, 9 Drawing Figures

Figure 2A:
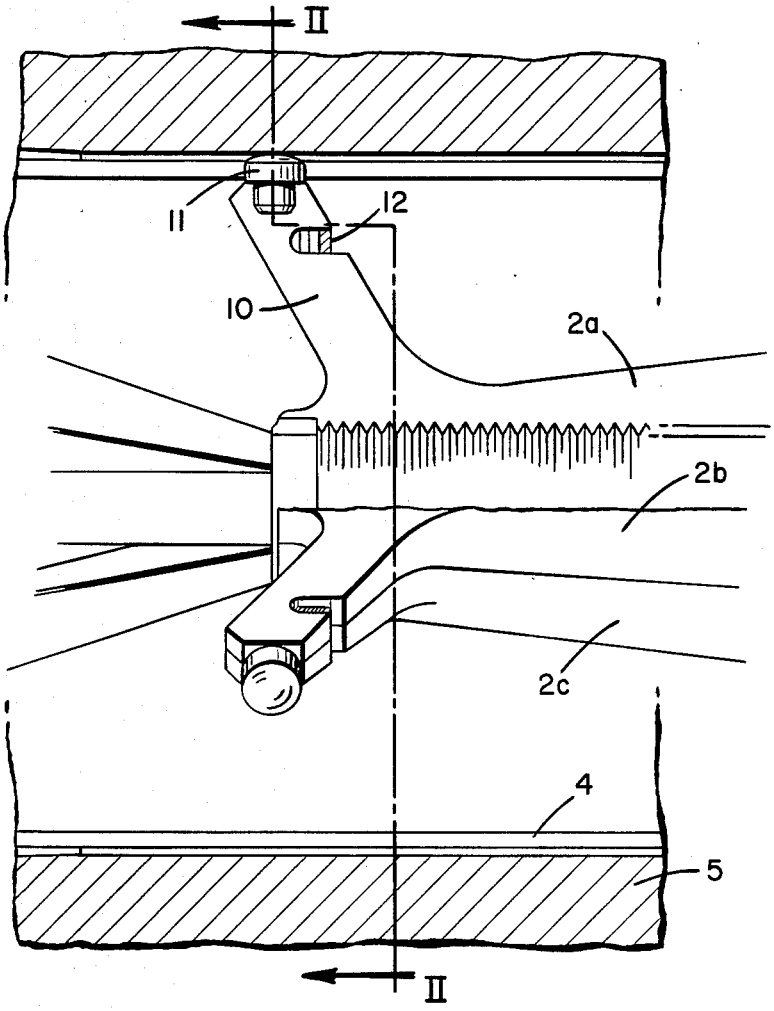

FIG. 1a
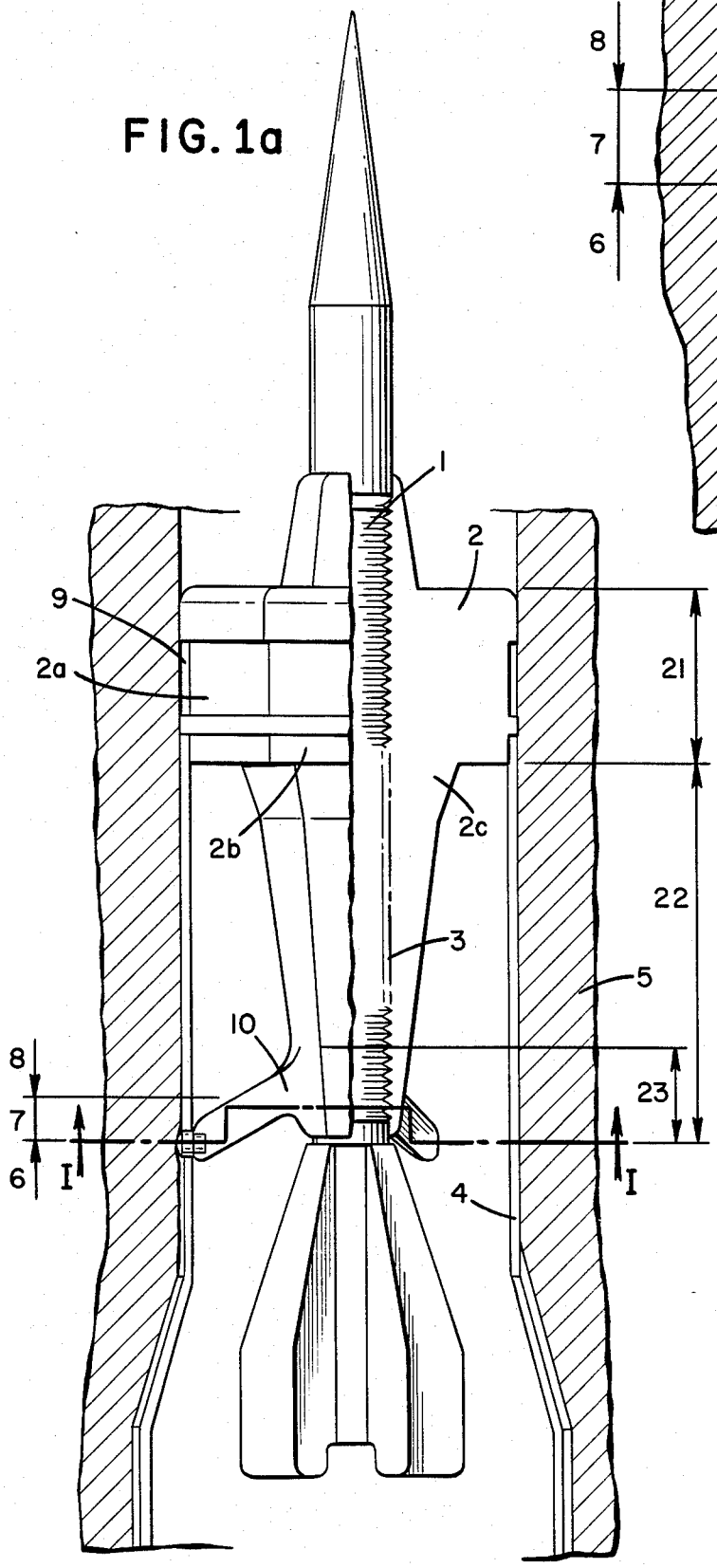
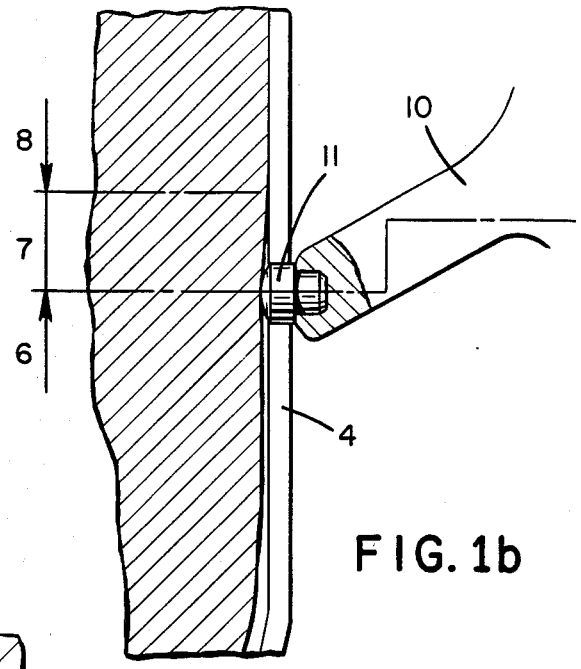
FIG. 1b
FIG. 1c
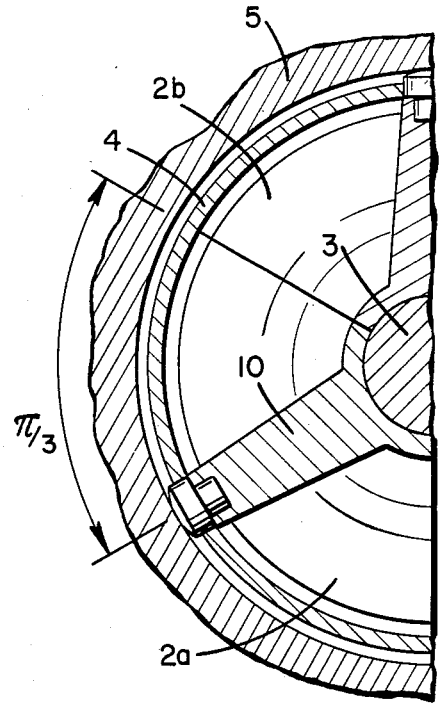

FINNED SUBCALIBER PROJECTILE

This is a continuation of application Ser. No. 300,107 filed Sept. 8, 1981, now abandoned.

The present invention relates to an anti-tank weapon comprising a finned projectile of the arrow type and a launching shoe.

In order to fire this type of ammunition under good conditions, the projectile must be held stationary in the tube of the weapon until a given threshold of the pressure of the propulsion gases has been reached, this threshold corresponding to the so-called forcing pressure. When this pressure is reached the movement of the projectile commences. This forcing pressure is one of the important parameters in internal ballistics, determining on the one hand the uniformity of the pairing of pressure of the combustion gases and initial velocity of the projectile and on the other hand the constancy of the muzzle pressure of the tube. The uniformity of this forcing pressure is necessary in order to obtain minimum dispersion with respect to the fire precision.

Forcing in the case of subcaliber kinetic-energy projectiles, which can be fired by means of a smooth tube, is at present effected in two different ways, depending on the nature of the case on which the projectile is mounted. When utilizing a metal case, the forcing is obtained by the crimping of the case on the shoe of the projectile. This technique is illustrated in U.S. Pat. No. 3,107,615 and French Pat. No. 2,331,771 which show the crimping of the case on a groove in the shoe of the projectile.

In the Example where projectiles are mounted on a combustible case, the forcing is produced by the friction of the sealing and guide bands of the shoe within the tube. Thus the forcing pressure is reached when the forces produced by the pressure of the gases overcome the frictional forces.

Whatever the technique employed, it is difficult to precisely control the elements which make it possible to obtain a substantially constant forcing pressure for a batch of ammunition. As a matter of fact, the crimping of the case on the projectile cannot be effected in a highly reproducible manner since there is permanent deformation of the case as a function of machining processes and of the grade from metal of which the case is manufacturing. When using combustible cases, the constancy of the forcing pressure depends, on the one hand on the nature of the sealing system, which is a function of the finish of the surface and the dimensional tolerances with respect to the band-tube pairing and on the other hand, the extent on wear of the tube or barrel of the weapon. While the dimensions can be easily controlled, the same is not true with respect to the finish of the surface of the tube which in order to be of a constant quality, requires particular care throughout the course of manufacturing.

The object of the present invention is to provide an effective solution for the forcing problems by eliminating the drawbacks of the known techniques, thereby reducing the dispersions in the forcing pressure and considerably improving the ballistic precision of the firing by assuring uniformity in the pairing of pressure of the combustion gases and initial velocity of the projectile and the constancy of the pressure at the muzzle of the tube of the weapon.

Another advantage resides in the fact that this type of solution permits easy mounting of the projectile in the case, while favoring the holding thereof.

The mounting, in accordance with the invention, advantageously makes it possible to reduce dispersion in the forcing pressure, even when the firing is effected from a worn tube.

The device of the present invention also makes it possible to provide means which assure the precise guidance of the projectile during the barrel phase, assuring its stability and contributing to the improvement in the precision of firing.

The object of the invention is therefore an antitank ammunition comprising:

a finned subcaliber kinetic energy, a launching shoe comprising a tubular portion which clamps onto the projectile and is used in the barrel phase for the guidance and propulsion of the projectile, and a case containing the propellant charge and on which the launching shoe is fastened, this ammunition coming into position resting against a forcing cone.

This weapon is characterized by the fact that the shoe comprises, in combination with the tubular portion, a front portion of the same caliber as the tube of the weapon, which permits guidance and tightness between the combustion chamber and the front of the tube, and a rear portion resting against the forcing cone and having recesses which permit the passage of the propulsion gases towards the forward portion of the shoe.

In another embodiment, the rear portion consists of at least two fins rigidly connected with the tubular portion of the shoe and the free ends of which rest against the forcing cone. The rear portion may also have three fins.

The ammunition in accordance with the invention is also characterized by the fact that the free end of the rear portion of the shoe has pins of deformable material which rest against the forcing cone.

When the ammunition has a non-combustible case, the case comprises the forcing cone and the rear portion of the shoe resting against said cone.

In a preferred embodiment and in the event that the ammunition comprises a combustible case, the pins arranged at the free end of the rear portion of the shoe come against the forcing cone of the tube through the case.

Other characteristics and advantages of the invention will become evident from the following detailed description read, with reference to the accompanying drawings which show various embodiments by way of illustration and not of limitation.

In the drawings:

FIG. 1*a* is a partial longitudinal section through a first embodiment of the projectile of the invention, FIG. 1*b* shows a detail of the rear portion of the projectile of FIG. 1 on a larger scale, FIG. 1*c* is a cross section along the line I.I. of FIG. 1*a*, FIG. 2*a* is a partial longitudinal section through the rear portion of a second embodiment.

Figure 2B:
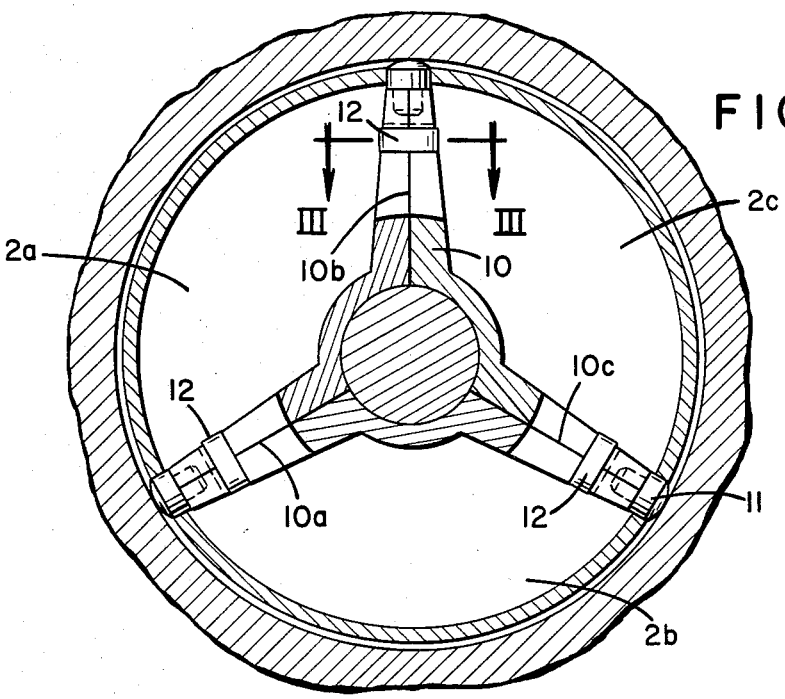
Figure 2C:
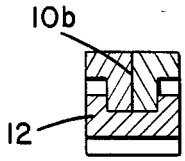
Figure 3A:
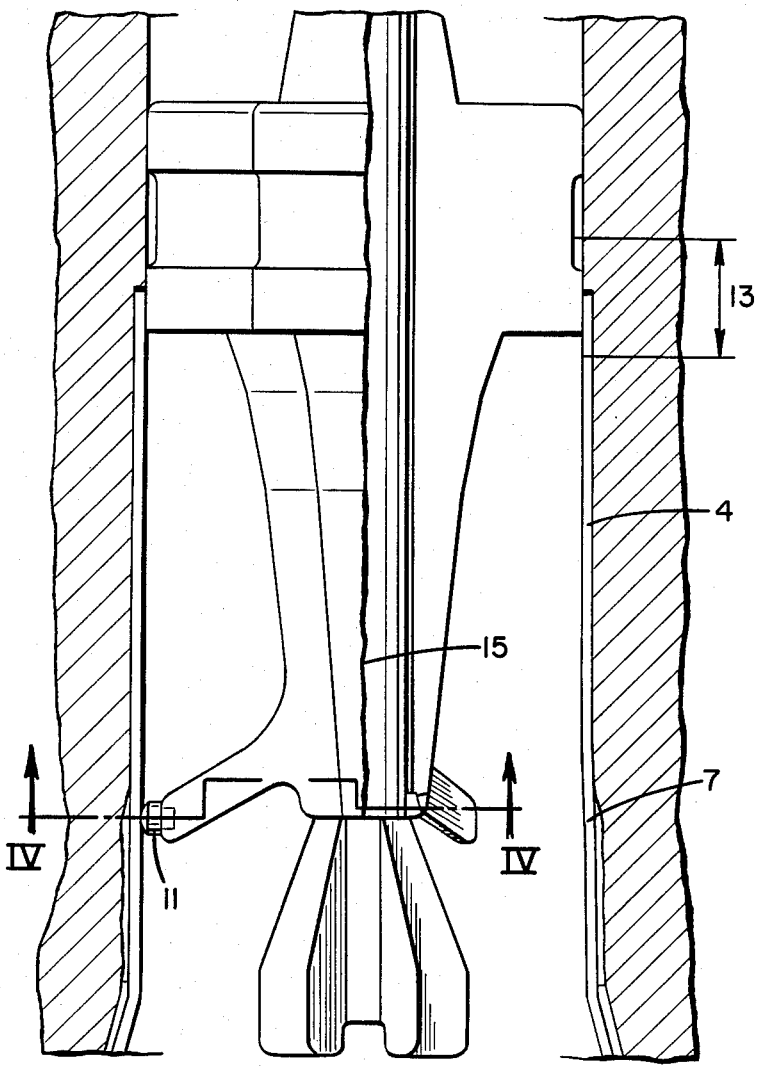
Figure 3C:
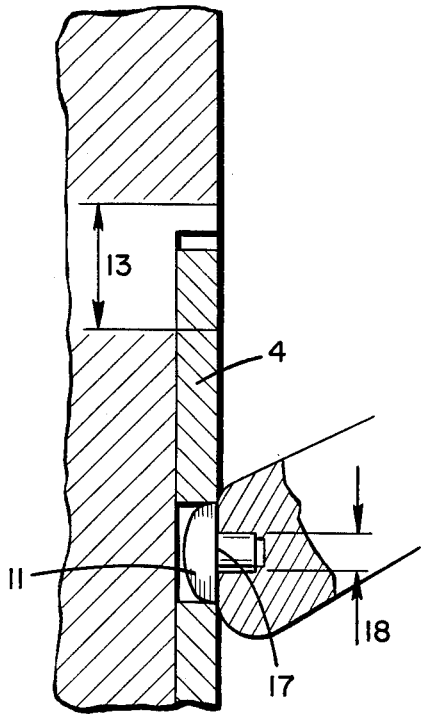
Figure 3B:
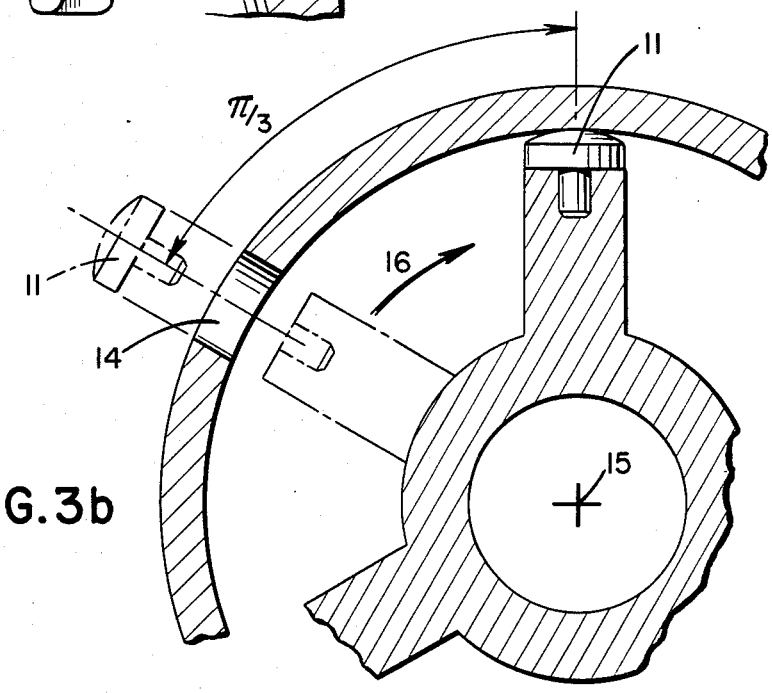

FIG. 2*b* is a cross section along the line II.II. of FIG. 2*a*,

FIG. 2*c* is a section along the line III.III. of FIG. 2*b*,

FIG. 3*a* is a partial longitudinal section through a third embodiment of a projectile in accordance with the invention, FIG. 3*b* is a cross section along the line IV.IV. of FIG. 3*a*.

FIG. 3*c* is a partial section through another variant, which can be used when the case is of a noncombustible material.

FIG. 1*a* shows a finned kinetic-energy projectile 1 driven during the barrel phase by a shoe 2 consisting of three shells 2*a*, 2*b* and 2*c*. At the outlet of the tube, the three shells are separated from the projectile because of the effect of aerodynamic forces, thus releasing the projectile from the three shells 2*a*, 2*b* and 2*c*. The driving of the projectile by the shoe is effected by known means such as threads 3 or grooves and tenons arranged on the interface of the projectile and the shells. The projectile is held in a case 4 which contains the propulsive charge and which, in this first embodiment, is a combustible material. In this figure, the ammunition is shown in place in the tube 5 of the weapon, which comprises the housing 6 of the case, the forcing cone 7 and the launching tube 8 proper. In this case, as the ammunition to be fired is stabilized by the fin assembly, the tube is not rifled, or is only slightly rifled.

The shoe 2 comprises a thrust plate 21 of the caliber outside diameter and a tubular portion 22 clamping the arrow and on which three fins 10 are fastened. The thrust plate 21 has a circular groove 9 within which there is arranged a suitable gasket which avoids leakages of propulsion gas during the internal ballistic phase. The lower ends of the fins 10 are attached to the tubular portion 22 while the free ends are provided with pins 11 which rest against the forcing cone 7 and pass through the case 4 (FIG. 1*b*). These pins consist of a deformable material, such as for instance filled or unfilled polyamides, copper or alloys. In this first embodiment, each shell 2*a*, 2*b* or 2*c* is provided with a fin, the contact surfaces between the shells being staggered by $\pi/3$ with respect to the fins (FIG. 1*c*).

FIGS. 2*a*, 2*b* and 2*c* show a second variant of the invention. In this example, the axes of symmetry 10*a*, 10*b* and 10*c* of the fins 10 are located in the planes of contact of the shells 2*a*, 2*b* and 2*c*. The assembling of these various parts is effected by means of clips 12 intended to break during the intermediate ballistic phase, thus facilitating the elimination of the shoe.

The pins 11 pass through the combustible case 4 in the same manner as in the preceding embodiment.

The assembling of the projectile and the case is effected by front loading the projectile into the case. The pins 11 are fastened through the holes 14 when the projectile is in position in the case. This solution affords the advantage of maintaining the projectile very firmly in the sleeve in view of the long length between the pins and the front portion of the case on the thrust plate 21. The projectile being mounted, the spaces between the case and the pins are filled in, thus assuring a tight packing of the propulsive charge.

FIGS. 3*a* and 3*b* show another variant of the invention in the event that the case used is metallic.

The forcing cone 7, which in the preceding examples was developed directly in the tube of the weapon, is now included within the case the inside diameter of the front end of which is at caliber, which assures continuity of the guidance of the projectile during the barrel phase on the portion 13 of the tube.

In this example, the ammunition may be assembled in two ways. A first method consists in introducing the complete projectile through the rear portion of the case, the latter being developed in two parts. In the case of a monoblock case, the projectile can be mounted via the front portion of the case provided that it is without pins 11, which are then fastened on the fins when the projectile is positioned in length. The passing of the pins takes place through the holes 14 provided in the case, which holes are closed after rotation of the projectile through an angle of about $\pi/3$ around its axis 15 in the direction indicated by the arrow 16 (FIG. 3*b*). The projectile is then rigidly secured to the case at the level of the thrust plate by crimping or bonding, effected in such a manner that upon the departure of the shot the forces due to the crimping or bonding are far less than those which permit the deformation of the forcing pins. This condition makes it possible to obtain constant forcing pressures which are practically independent of the manner of attachment of the projectile to the case.

FIG. 3*c* shows another variant, which can be used only in the event that the case is of metal. The inside diameter of the front end of the case is at caliber so as to assure continuity of the guidance of the projectile on the portion 13 of the tube. In this particular case, the forcing is obtained by the shearing of the section 17 of the pins 11, which are implanted at the rear ends of the fins and a part of which is included within the wall of the case 4. The diameter 18 of the shearing section 17 is calculated in such a manner as to reach the desired forcing pressure. After shearing, the guidance of the rear portion of the shoe is effected by the rear ends of the fins. The mounting of the ammunition in the case is effected in the same way as in the event that the sleeves are combustible (FIGS. 1*a* to 2*c*) and it offers the same advantages.

Operation is as follows: When the propulsive charge is initiated, gases are generated and cause an increase in pressure within the propulsion chamber. The projectile is held stationary due to the fact that the pins are resting against the forcing cone which is arranged either in the tube (FIGS. 1 and 2) or in the metal sleeve (FIG. 3). When the forcing pressure has been reached, the pins are deformed under the action of the thrust and clear the forcing cone releasing the projectile which is propelled in the tube. The guidance is provided via the side surface of the thrust plate and by the forcing pins.

These different variants offer numerous advantages. As a matter of fact, these projectile configurations make it possible on the one hand, via the fins, favorably to displace the forces caused by the movement of the gun tube. Thus disturbances on the projectile are decreased and fire dispersion reduced. On the other hand, the fact that the forcing is effected by means of fins and pins arranged at the rear of the launching shoe makes it possible, as compared with the known projectiles, to displace the thrust plate towards the front. This is of particular interest since the propulsive charge volume is increased which substantially improves the performance of this type of projectile.

We claim:

1. Ammunition to be launched from a barrel of a weapon comprising:

a finned subcaliber-sized projectile;

a combustible tubular case surrounding a rear part of said projectile and containing a propulsive charge;

at least two longitudinal shell portions together comprising a launching shoe for launching movement with said projectile along a barrel of a weapon, said shoe being partially disposed within said tubular case and having an inner portion in form locking engagement with said projectile to prevent axial shifting between said shoe and said projectile while said shoe and said projectile are within said barrel but allow radial separation of said longitudinal shell portions from said projectile upon exit of said shoe and said projectile from said barrel;

said shoe comprising a tubular middle portion extending between a front portion and a rear portion of said shoe;

said front portion being disposed forward of said tubular case and being caliber-sized to create a seal between a combustion chamber and a front part of said barrel of said weapon;

said rear portion having recesses to permit passage of propulsive gases toward said front portion and having above caliber-sized projections extending through holes in said tubular case to frictionally engage a forcing cone of said barrel, the frictional engagement between said projections and said forcing cone being such as to limit movement of said shoe during launch until said propulsive gases reach a forcing pressure.

2. The ammunition of claim 1, wherein said rear portion of said launching shoe comprises at least two radial fins having pins at the outer ends thereof extending through said tubular case, said pins comprising said above caliber-sized projections.

3. The ammunition of claim 2, wherein said pins are comprised of a deformable material such that said pins will deform to allow movement of said shoe when said propulsive gases reach said forcing pressure.

4. The ammunition of claim 2, wherein said longitudinal shell portions comprising said launch shoe contact each other along a longitudinal axis of symmetry of said radial fins.

5. The ammunition of claim 4, wherein said longitudinal shell portions are held together by clips.

6. The ammunition of claim 5, wherein said clips are designed to break during an intermediate ballistic phase.

7. Ammunition to be launched from a barrel of a weapon comprising:

a finned subcaliber-sized projectile;

a non combustible tubular case surrounding a rear part of said projectile and containing a propulsive charge;

at least two longitudinal shell portions together comprising a launching shoe for launching movement with said projectile along a barrel of a weapon, said shoe being partially disposed within said tubular case and having an inner portion in form locking engagement with said projectile to prevent axial shifting between said shoe and said projectile while said shoe and said projectile are within said barrel but allow radial separation of said longitudinal shell portions from said projectile upon exit of said shoe and said projectile from said barrel;

said shoe comprising a tubular middle portion extending between a front portion and a rear portion of said shoe;

said front portion being disposed forward of said tubular case and being caliber-sized to create a seal between a combustion chamber and a front part of said barrel of said weapon;

said rear portion having recesses to permit passage of gases toward said front portion and having above caliber-sized projections to frictionally engage a forcing cone of an internal surface of said tubular case, the frictional engagement between said projections and said forcing cone being such as to limit movement of said shoe during lauch until said propulsive gases reach a forcing pressure.

8. The ammunition of claim 7, wherein said rear portion of said launching shoe comprises at least two fins having pins at the outer ends thereof, said pins comprising the projections which frictionally engage said forcing cone.

9. The ammunition of claim 8, wherein said pins are comprised of a deformable material such that said pins will deform to allow movement of said shoe when said propulsive gases reach said forcing pressure.

10. The ammunition of claim 8, wherein said longitudinal shell portions comprising said launch shoe contact each other along a longitudinal axis of symmetry of said radial fins.

11. The ammunition of claim 10, wherein said longitudinal shell portions are held together by clips.

12. The ammunition of claim 11, wherein said clips are designed to break during a intermediate ballistic phase.

13. Ammunition to be launched from a barrel of a weapon comprising:

a finned subcaliber-sized projectile;

a non-combustible tubular case surrounding a rear part of said projectile and containing a propulsive charge;

at least two longitudinal shell portions together comprising a launching shoe for launching movement with said projectile along a barrel of a weapon, said shoe being partially disposed within said tubular case and having an inner portion in form locking engagement with said projectile to prevent axial shifting between said shoe and said projectile while said shoe and said projectile are within said barrel but allow radial separation of said longitudinal shell portions from said projectile upon exit of said shoe and said projectile from said barrel of said weapon;

said shoe comprising a tubular middle portion extending between a front portion and a rear portion of said shoe;

said front portion being disposed forward of said tubular case and being caliber-sized to create a seal between a combustion chamber and a front part of said barrel of said weapon;

said rear portion having recesses to permit passage of propulsive gases toward said front portion and having projections extending at least partially through hole in said tubular case to limit movement of said shoe during launch until said propulsive gases reach a forcing pressure, said projections shearing at an inner surface of said tubular case to allow movement of said shoe when said propulsive gases reach said forcing pressure.

14. The ammunition of claim 13, wherein said rear portion of said launching shoe further comprises at least two radial fins having pins at the outer ends thereof, said pins comprising said projection extending at least partially through said tubular case.

15. The ammunition of claim 14, wherein said pins are comprised of a deformable material such that said pins will deform to allow move ment of said shoe when said propulsive gases reach said forcing pressure.

16. The ammunition of claim 14, wherein said longitudinal shell portions comprising said launch shoe contact each other along a longitudinal axis of symmetry of said radial fins.

17. The ammunition of claim 16, wherein said longitudinal shell portions are held together by clips.

18. The ammunition of claim 17, wherein said clips are designed to break during an intermediate ballistic phase.

* * * * *